US007547161B2

(12) United States Patent
Gascon

(10) Patent No.: US 7,547,161 B2
(45) Date of Patent: Jun. 16, 2009

(54) APPARATUS FOR POSITIONING ANCHOR BOLTS AND METHOD OF USING SAME

(75) Inventor: Rheal Gascon, Hanmer (CA)

(73) Assignee: Mansour Mining Inc., Sudbury, Ontario (CA)

( * ) Notice: Subject to any disclaimer, the term of this patent is extended or adjusted under 35 U.S.C. 154(b) by 0 days.

(21) Appl. No.: 12/010,783

(22) Filed: Jan. 30, 2008

(65) Prior Publication Data

US 2008/0205997 A1 Aug. 28, 2008

(30) Foreign Application Priority Data

Feb. 22, 2007 (CA) ..... 2579385

(51) Int. Cl.
*E21D 20/00* (2006.01)

(52) U.S. Cl. ..... 405/302.2; 405/259.1; 405/288

(58) Field of Classification Search ..... 405/259.1, 405/288, 302.1, 302.2, 259.4; 403/368
See application file for complete search history.

(56) References Cited

U.S. PATENT DOCUMENTS 1,585,668 A * 5/1926 Hansen ..... 384/24
3,259,403 A * 7/1966 Hjalsten et al. ..... 285/121.3
4,420,277 A * 12/1983 Hibbard et al. ..... 405/259.5
5,147,145 A * 9/1992 Facey et al. ..... 403/314
6,698,529 B2 * 3/2004 Coombs et al. ..... 173/4
6,793,445 B1 * 9/2004 Charlton et al. ..... 405/259.5
7,066,688 B2 * 6/2006 Wallstein et al. ..... 405/302.2
7,384,216 B2 * 6/2008 Wallstein et al. ..... 405/302.2
2007/0183850 A1 * 8/2007 Hedrick ..... 405/259.1

* cited by examiner

*Primary Examiner*—David J Bagnell
*Assistant Examiner*—Benjamin Fiorello

(57) ABSTRACT

An apparatus for positioning a reinforcing tendon into a drill hole formed rock face including a body portion having a bore extending axially therethrough. The bore has a dimension selected to allow limited sliding movement of the tendon therethrough and includes a portion which tapers inwardly from a forward outfeed end towards a rearward or infeed end. A wedging member is movably provided in the bore. Movement of the wedging member towards the rearward end of the body results in its frictional engagement with the tendon to restrict its withdrawal from the body relative to the infeed end, whereas movement of the wedging member relative to the bore towards the outfeed end results in its disengagement from the tendon allowing it to be repositioned forwardly relative to the body. A drive is further provided to reciprocally move the body relative to the rock face.

19 Claims, 7 Drawing Sheets

APPARATUS FOR POSITIONING ANCHOR BOLTS AND METHOD OF USING SAME

SCOPE OF THE INVENTION

The present invention relates to an apparatus for positioning anchor bolts or reinforcing tendons used in mine and wall support systems, and more particularly an apparatus which is operable to urge the reinforcing tendon into a drill hole formed in a rock face to a seated position where it may be secured in place by mechanical couplers, resins and/or grouts.

BACKGROUND OF THE INVENTION

In concrete wall, mine roof and rock wall support systems (hereinafter collectively referred to as mine roof support systems), it is known to stabilize ground forces by first embedding longitudinally elongated reinforcing tendons in bore or drill holes drilled into the rock complex, and then tightening a nut against the wall or rock face to compress and consolidate rock forces.

To form drill holes, pneumatically operated boring tools, such as a hand-held or ground supported stoper or jackleg is used. The boring tools are provided with a reciprocally movable air-leg, to which is coupled a drill steel or rod. The reciprocal movement of the air-leg is used to drive the drill steel into the rock face to a desired depth preferably selected at between about 6 and 12 feet. Typically, anchor or reinforcing tendons consist of a six or twelve foot long steel rebar, a cone bolt or a cable or strand bolt which is provided with a series of bosses or bulges along its length. To permit the tightening of the nut used to provide rock compression, the outermost end of the tendon which protrudes from the rock face is threaded or otherwise adapted to receive the tensioning nut or other fastener which may be tightened against the rock face. The reinforcing tendons are fixedly retained in the drill hole by either mechanical couplers which are activatable to frictionally engage the sides of the drill hole, or through adhesion by the use of mixed grouts or resins.

Where grout or resins are used to adhere tensioning members in place, typically a number of two-part resin or grout (hereinafter collectively referred to as resin) cartridges are pre-inserted into the bore hole immediately ahead of the reinforcing tendon. The tendon is then inserted into the drill hole with a sufficient force to rupture or pierce the resin cartridges. Once properly seated, the tendon is thereafter spun or rotated about its longitudinal axis to assist in the mixing of the resin to ensure more complete setting.

The applicant has appreciated that the length of conventional reinforcing tendons used in mine roof support systems, and the requirement of seating the tendon into elongate drill holes against the resistive forces of both multiple unruptured resin/grout cartridges, and the viscous forces of the released resin, makes the manual insertion of the tendon in the bore hole both difficult and time consuming. Furthermore, if the tendon is not fully seated in the bore hole and spun before the anchoring resin sets, the tendon may not be positioned at a sufficient depth in the rock complex to provide reliable consolidating forces. This in turn may result in either the failure of the anchor tendon, or in a worst case scenario rock wall failure.

In an effort to overcome the difficulties associated with manual positioning of reinforcing tendons, mechanical devices have been proposed for pushing reinforcing tendons into drill holes formed in rock complexes. Conventional tendon pushing apparatus typically include a pair of power driven counter rotating drive wheels. The drive wheels are positioned a distance apart so as to frictionally engage opposing sides of a tendon moved therebetween. In this manner, the rotation of the wheels drives the tendon in forward movement into the drill hole. The requirement of providing a separate apparatus, however, to position reinforcing tendons has not achieved widespread acceptance in the mining industry, as a result of the increased costs and inconvenience associated with providing and transporting separate drilling and positioning tools to a mine work site.

In addition, in underground mining operations dust, dirt and mining debris frequently results in the jamming of the drive wheels often binding the reinforcing tendon therein, and necessitating frequent repair and/or replacement.

SUMMARY OF THE INVENTION

To at least partially overcome some of the disadvantages associated with prior art wall and mine roof support systems, the present invention provides an apparatus and method for the simplified positioning or insertion of reinforcing tendons within drill holes formed in a rock complex.

Another object of the invention is to provide a tendon positioning apparatus which is adapted for use in either conventional concrete wall, rock wall or mine roof support systems, and which enables a single user to quickly and easily achieve full seating of a reinforcing tendon at the desired location relative to the rock face.

Another object of the invention is to provide an apparatus for use in pushing or slidably urging a reinforcing tendon forwardly into a bore or drill hole formed in a rock face, and which is operable to rapidly seat the tendon prior to the setting of any adhesive resins used in the securement of the tendon relative to the drill hole.

Another object of the invention is to provide a simplified apparatus for use in positioning conventional six or twelve foot long mine roof reinforcing tendons such as a rebar, cone bolts, strand cables, or bulged cable bolts into drill holes and which has a simplified construction which minimizes the possibility of apparatus failure or that the tendon may become jammed therein as a result of clogging by debris.

Another object of the invention is to provide a modified rock boring tool such as a stoper or jackleg which has a tendon pusher or positioning tool permanently or detachably coupled thereto, and whereby the boring tool may be activated by a user to both form a desired drill hole and thereafter position a reinforcing tendon therein without the use of a separate pushing tool.

Another object of the invention is to provide a simplified method and system for the installation and placement of reinforcing tendons in a rock complex by a single user, and without the necessity of purchasing and/or positioning separate boring and tendon pushing tools at an individual work site.

A further object of the invention is to provide an apparatus for use in sliding a reinforcing tendon forwardly to a seated position within a drill hole formed in a rock face, and which has a simplified construction enabling the apparatus to be quickly and economically manufactured and/or repaired.

In a simplified construction, the present invention provides a reinforcing tendon positioning apparatus for use in mine roof support systems and which is operable to slidably urge or otherwise pushing a desired reinforcing tendon into a drill hole formed into a wall or rock complex. The positioning apparatus includes a body portion having a bore which is elongated in a generally axial direction extending therethrough. The bore has an overall dimension selected to allow at least limited sliding movement of a selected tendon through the body, from an infeed end opening, along the bore, and then outwardly therefrom via an outfeed opening. At least a part of the sidewall surface bore tapers inwardly from the outfeed end of the body towards the infeed end, to provide the bore with relatively larger and smaller diameter sections.

A wedge member is provided at least partially in the bore and movable axially therein relative to the tapered surface. The wedge member may for example consist of a movable metal, ball, a metal or steel cylinder, an elliptical member, or other suitably shaped wedging element which has a profile chosen so as to be selectively frictionally engageable with part of the tendon located within the bore. Movement of the wedge member relative to the body towards the outfeed end results in its repositioning in a comparably larger diameter portion of the bore where it is sufficiently disengaged from the tendon to enable the tendon to move relative thereto. In particular, in such a location, the tendon is not held by frictional engagement with the wedge member and/or the remainder of the bore. This results in the tendon being "unlocked" from the wedge member and the tendon to be moved along the bore and out from the outfeed end relative to the body. As the tendon moves through the outfeed end, its contact with the wedge member tends to urge the wedge member further towards the larger diameter portion of the bore As the wedge member moves axially closer to the infeed end of the body, the smaller bore diameter results in the wedge member moving into mechanical frictional contact with both the tapering bore sidewall and the part of the tendon. The tapering sidewall thus forces the wedge member into engagement against the tendon. Any further movement of the tendon outwardly through the infeed end relative to the body results in the wedge member being drawn still closer towards the infeed end and further into the smaller diameter section. This effectively increases the frictional force applied to the tendon by the wedge member to a point to restrict further relative movement of the tendon relative to the body.

In use of the apparatus, the outfeed opening is preferably oriented forwardly, proximatemost to the face of the rock complex, with the tendon slid forwardly therethrough into a drill hole. It is to be appreciated in an alternate configuration, where for example a tendon is to be extracted from a bore hole, the apparatus could be used in a reverse orientation with the outfeed opening provided remote from the rock face.

The applicant has appreciated that reciprocal movement of the positioning apparatus with its bore axis generally aligned with a drill hole axis may be used to slidably urge a tendon forwardly through the apparatus, and into the drill hole against the resistive forces of adhesive cartridges and/or the viscosity of any resin released therefrom.

Although not essential, most preferably the tendon positioning tool is provided as part of a stoper, jackleg or other rock boring tool having a reciprocally movable portion such as an air-leg which is used to reciprocally support a drill steel. In a simplified construction, the tendon positioning tool is temporarily, or more preferably, permanently provided directly on the air-leg, such that the bore axis of the positioning tool is generally aligned with the axial length of the drill steel. Following the formation of the drill hole, the activation of the reactivation boring tool thus may be used to again reciprocally move the positioning tool together with the air-leg, to urge a reinforcing tendon into the drill hole.

Accordingly, in one aspect the present invention resides in a tendon positioning apparatus for urging a reinforcing tendon forwardly into a bore hole formed in a rock face, the apparatus comprising, a body having a rearward infeed end and a forward outfeed end positionable proximate to said rock face, an axially extending bore extending through the body from the infeed end to the outfeed end, the bore being generally frustoconically shaped and tapering inwardly from an enlarged diameter portion spaced towards the outfeed end to a reduced diameter portion spaced towards the infeed end, the reduced diameter portion being sized to permit sliding movement of the tendon therethrough, a wedge member disposed at least partially in said bore and movable in an axial direction relative to said body between an engaging position, wherein said wedge member is spaced towards the reduced diameter portion to be frictionally engageable with a tendon therein, such that engagement between the tendon and the bore and/or the wedge member restricts axial movement of the tendon rearwardly relative the infeed end, and an uncoupled position, wherein said wedge member is moved towards the enlarged diameter portion to permit forward sliding of the tendon relative to the outfeed end of the body.

In another aspect, the present invention resides in a rock boring tool for use with a drill steel for forming a drill hole in a rock face, the tool comprising a vertically elongated air-leg and a drive selectively operable to reciprocally move said air-leg in a vertical direction, the air-leg including a nose portion positionable proximate to the rock face and having a socket configured for coupling the drill steel thereto, and a tendon positioning assembly for urging a reinforcing tendon into the drill hole, the assembly comprising, a body, a bore extending through the body along an axis from an infeed end opening to the outfeed end opening, the bore having at least one surface portion tapering inwardly from an enlarged diameter portion spaced towards the outfeed end opening towards a reduced diameter portion spaced towards infeed end opening, the bore being sized to permit sliding movement of the tendon therealong, a wedge member disposed at least partially in said bore, the wedge member movable in the axial direction relative to said body between an engaging position spaced towards the reduced diameter portion so as to be frictionally engageable with a tendon, whereby engaging contact between the tendon and at least one of the bore and the wedge member restricts relative axial sliding of the tendon downwardly from the body, and an uncoupled position wherein said wedge member is moved towards the enlarged diameter portion to permit sliding of the tendon upwardly relative to the body, the body further defining a generally vertically elongated open throat extending laterally into the bore, the throat being sized to permit movement of the tendon therethrough into the bore.

In a further aspect, the present invention resides in a tendon positioning apparatus for sliding a reinforcing tendon into a drill hole formed in a rock face, the apparatus comprising, a body having a rearward infeed end opening and a forward outfeed end opening, a bore extending generally axially through the body from the infeed end opening to the outfeed end opening, the bore sized to permit limited sliding movement of the tendon therethrough and having at least one sidewall portion tapering inwardly from an enlarged diameter portion spaced closest the outfeed end towards a reduced diameter portion spaced towards the infeed end opening, a wedge member disposed in said bore and movable in an axial direction relative to said body between an engaging position, wherein said wedge member is spaced towards the reduced diameter portion whereby frictional engagement between the tendon and at least one of the bore and the wedge member restricts axial sliding of the tendon rearwardly relative the infeed end opening, and an uncoupled position, wherein said wedge member is moved towards the enlarged diameter portion to permit relative sliding of the tendon forwardly from the outfeed end opening therepast.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
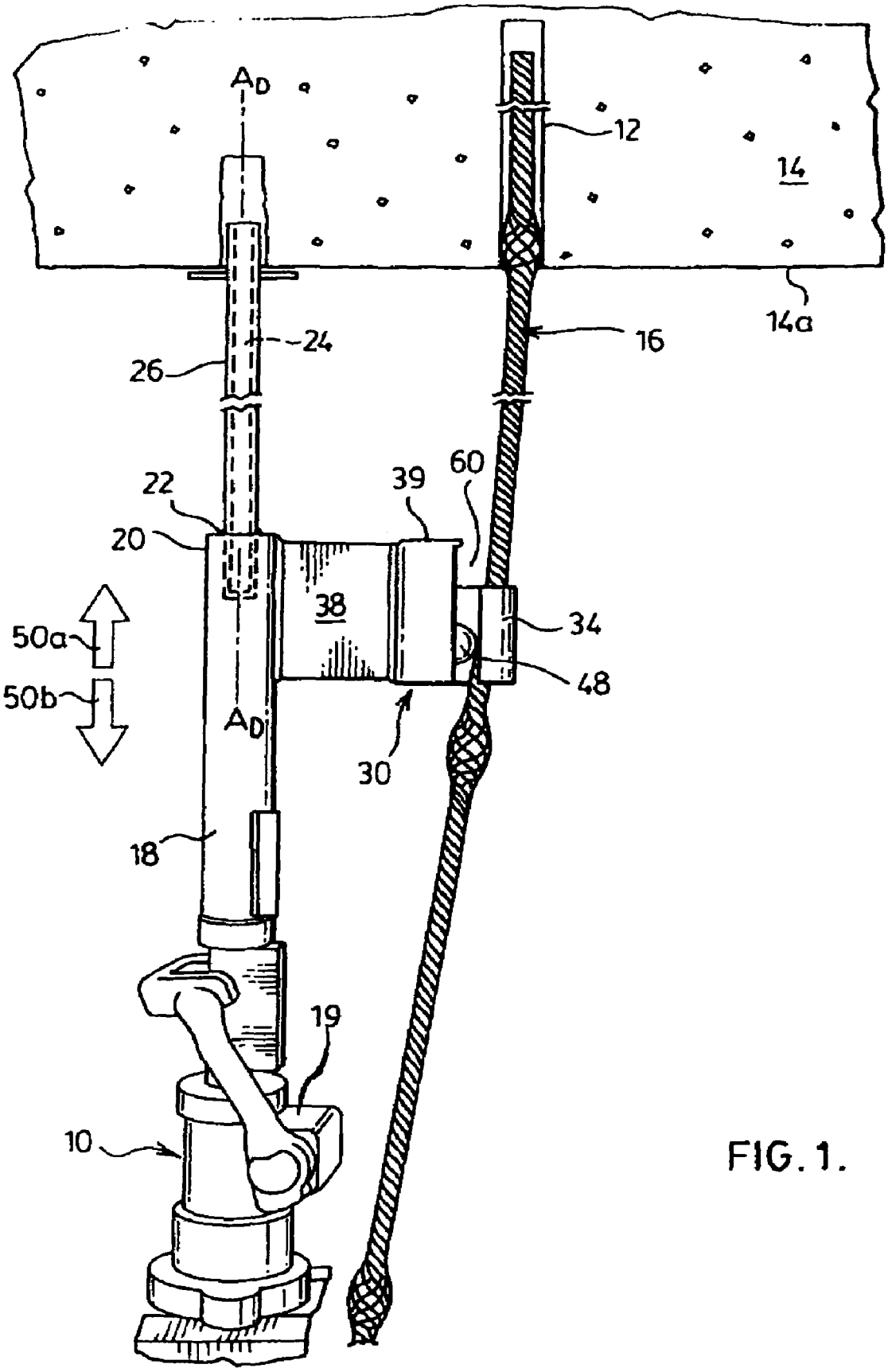
FIG. 1 shows a schematic view of a stoper which incorporates a tendon having a tendon positioning tool in accordance with a preferred embodiment of the invention.

The present invention relates to a stoper 10 for use in the installation of mine roof support systems. As will be described, the stoper 10 is operable by a single user to initially form a drill hole 12 in a rock roof complex 14, and thereafter position and seat a bulged cable bolt 16 in the drill hole 12 as a reinforcing tendon for use in compressing and consolidating rock forces. The stoper 10 is sized to be manually held by a single individual operator at an intended site of use. The stoper 10 includes an elongated pneumatically operable air-leg 18 which in use is positioned in a generally vertical orientation and then reciprocally moved in the forward and rearward directions of arrows 50*a*, 50*b* by way of drive 19 towards and away from the rock complex 14. The nose end 20 of the air-leg 18 is provided with a chuck 22 which is configured to matingly receive therein a longitudinally elongated drill steel 24. Although not essential, a removable steel sleeve 26 is preferably provided for selective positioning over the drill steel 24 in co-axial alignment with the longitudinal length of the drill axis $A_D$-$A_D$. The sleeve 26 is formed as a hollow tube which is adapted for sliding insertion over the drill steel 24 to protect it against accidental damage, while the stoper 10 is either transported and/or used for tendon positioning applications.

FIG. 1 shows best the air-leg 18 as having a tendon pusher or positioning tool 30 welded thereto. As will be described, positioning tool 30 is operable to forwardly slide a cable bolt 16 positioned therein into the formed drill hole 12. The tendon positioning tool 30 includes a hardened steel barrel-shaped body 34 and mounting bracket 38. As shown best in FIGS. 2 and 3, the body 34 is generally cylindrical in shape, having an overall axial length of between about 20 and 30 cm and a radial diameter selected at between about 5 and 15 cm. The body 34 has a frustoconically-shaped bore 36 formed therein which extends along and is symmetrical about a bore axis $A_B$-$A_B$. The mounting bracket 38 is secured along an edge side of the body 34 by weldments. The bracket 38 is used to fixedly couple the body 34 to the nose end 20 of the air-leg 18 with the bore axis $A_B$-$A_B$ of the tool substantially aligned with the axis $A_D$-$A_D$ (FIG. 1) of the drill steel 24. Although not essential, preferably the mounting bracket 38 has a lateral width selected at between about 3 and 25 cm, and more preferably about 12 to 15 cm so as to radially position the bore axis $A_B$-$A_B$ a distance marginally offset from the drill steel axis $A_D$-$A_D$.

Figure 2:
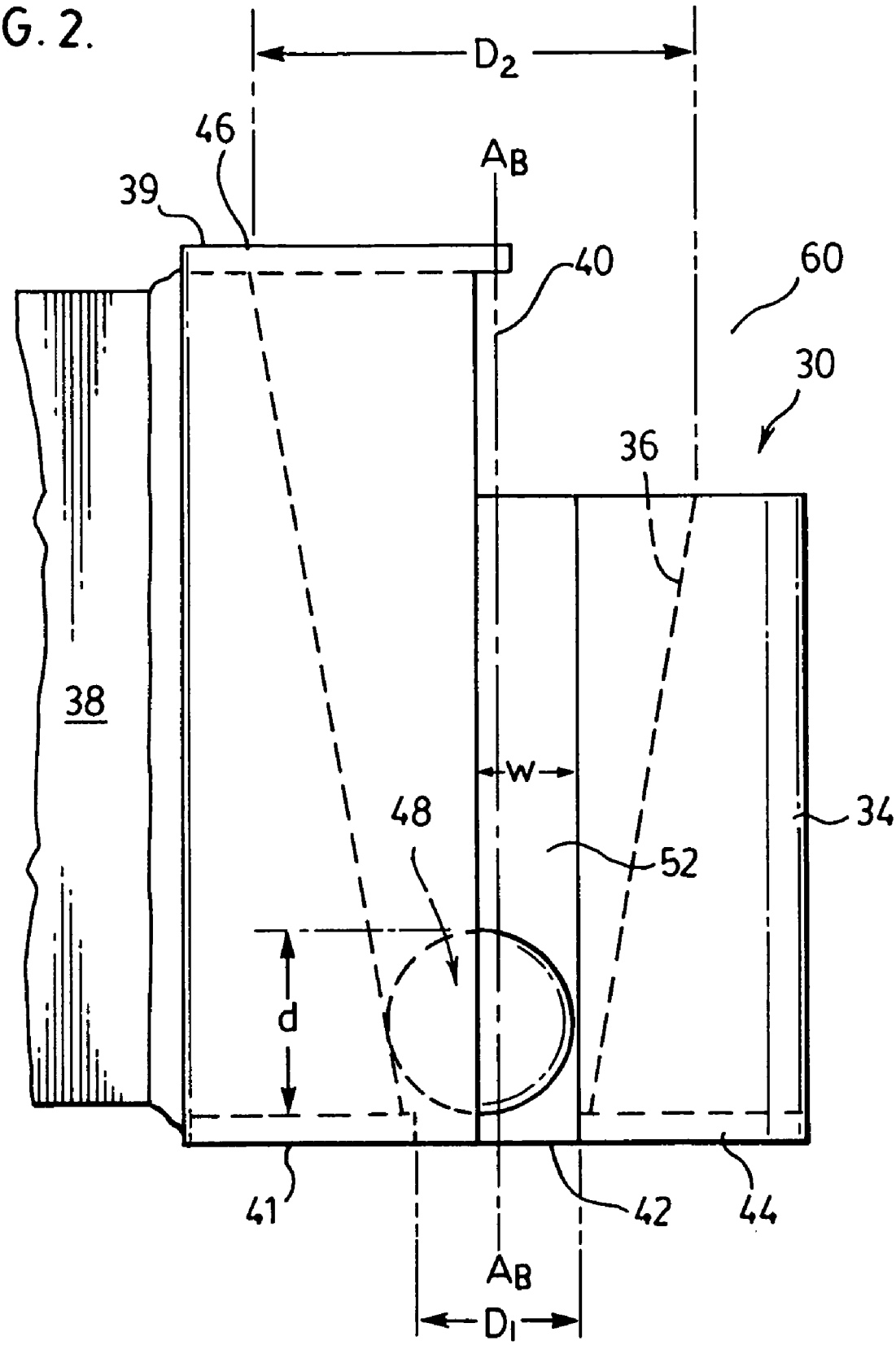
FIG. 2 illustrates an enlarged schematic cross-sectional view of the tendon positioning tool used with stoper shown in FIG. 1.
Figure 3:
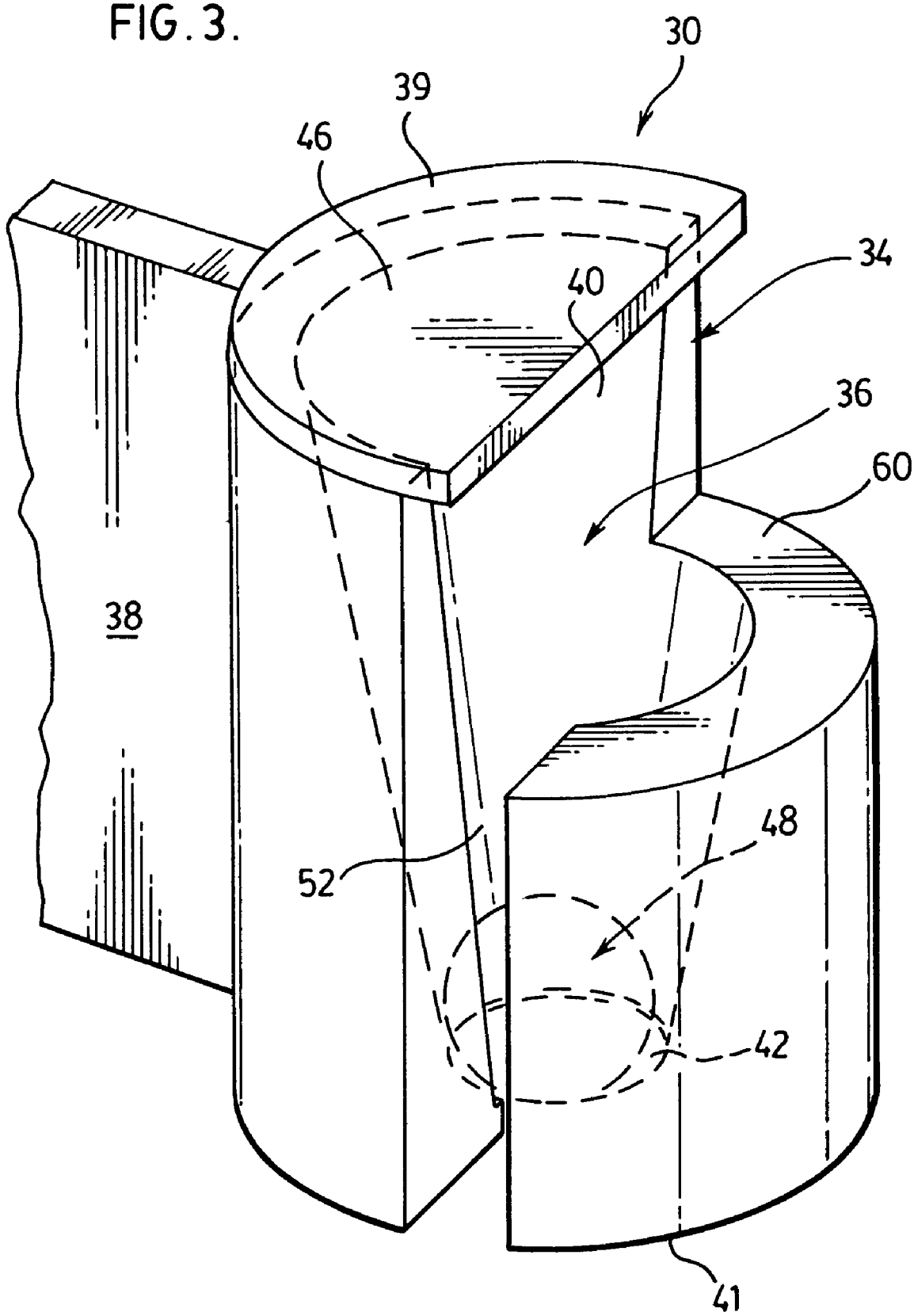
FIG. 3 illustrates a schematic perspective view of the positioning tool shown in FIG. 2.

FIG. 2 illustrates the bore 36 as tapering inwardly from an enlarged diameter portion adjacent a forwardmost end 39 of the body 34, which in use of the stoper 10 orients upwardly closest to the rock complex 14; to a reduced diameter portion adjacent a rearwardmost end 41 of the body 34, which in use of the stoper 10 is remote from the rock complex 14. Although not essential, the bore 36 preferably tapers at a constant angle from a maximum diameter $D_2$ of about 5 to 10 cm, to a minimum diameter of about 2.5 to 6 cm. It is to be appreciated, however, that the invention is not so limited. If desired, the bore 36 could be provided with different diameters and/or alternately one or more sidewall portions which taper or curve at different angles without departing from the spirit and scope of the invention.

An outfeed opening 40 is formed in the body through the forwardmost end 39. Similarly, an infeed opening 42 is formed through the body 34 through the rearwardmost end 41. Each of the infeed opening 42 and outfeed opening 40 are open into the bore 36 and are sized to permit movement of the tendon 16 therethrough. The infeed opening 42 preferably has a diameter $D_1$ (FIG. 2) which is selected marginally larger than the largest diameter portion of the cable bolt 16. Although not essential, for ease of manufacture, the infeed opening 42 may be defined by a bottom cover plate 44 or, alternately, by the direct machining of the bore 36 in the body 34.

FIG. 2 shows best approximately one-half of the outfeed opening 40 which is radially closest to the air-leg 18 as being closed by an optional top cover plate 46. As will be described, the top cover plate 46 is used in maintaining the positioning of a steel caming or wedge ball 48 within the bore 36 as the stoper 10 is used to urge the cable bolt 16 forwardly into the drill hole 12. FIG. 2 further shows the forwardmost end 39 of the body 34 as including a notched opening 60 which opens into the bore 36. The notched opening 60 preferably extends axially 1 to 5 cm, whereby the portion of the body 34 which is radially remote from the air-leg 18 is removed. As will be described, the presence of a notched opening 60 facilitates the movement of the bulged portions 56 (FIG. 4) of the cable bolt 16 along the bore 36 and through the body 34, as the positioning tool 30 is used.

In a simplified construction, the wedge ball 48 is preferably a spherical hardened steel ball. The ball 48 has a diameter d which most preferably is selected marginally greater than the diameter $D_1$ of the infeed opening 42, minimizing the possibility that the ball 48 may accidentally drop from the body 34. Where the stoper 10 is used in the installation of bulged cable bolts 16 which are characterized by unbulged cable portions 54 having a diameter of between about 1 and 2 cm, and longitudinally spaced bulged portions 56, the diameter of the caming ball 48 is preferably selected at between about 1 and 5 cm, and more preferably about 4 cm.

A longitudinally extending throat opening 52 is formed through the sidewall of the body 34 from the infeed opening 42 to the outfeed opening 40, and opens into the bore 36. Although not essential, preferably the throat 52 is oriented with its longitudinal length substantially aligned with the axis $A_B$-$A_B$. The throat opening 52 has a lateral width W (FIG. 2) which is preferably selected at 0.5 to 1.5 cm larger than the unbulged portion 54 of the cable bolt 16, but not larger than the cable bulges 56. The opening 52 advantageously permits the lateral placement of the cable bolt 16 into the bore 36 in readiness of the stoper 10 for use in sliding the cable bolt 16 into the drill hole 12.

Figure 6:
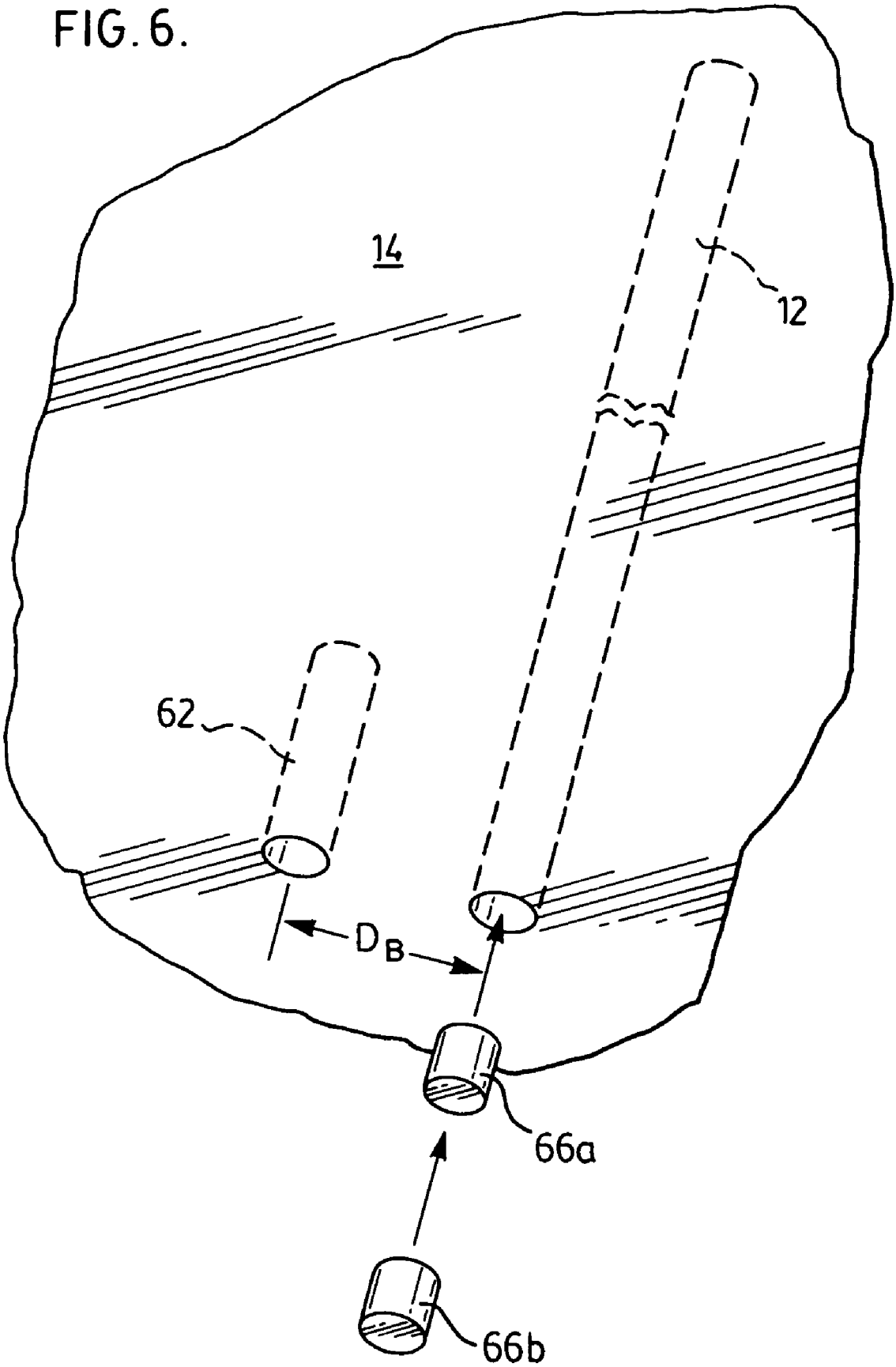
FIG. 6 illustrates a schematic view of the roof of a mine shaft illustrating the relative positioning of a drill hole and a guide hole in use of the stoper of FIG. 1.

In the installation of a cable bolt 16, the sleeve 26 is initially removed from the stoper 10 to expose the drill steel 24. Thereafter, the stoper 10 is positioned in a vertical orientation at the desired location and the air-leg 18 activated to vertically move the drill steel 24 into the rock complex 14 to form the drill hole 12 to a desired depth of between about 6 and 12 feet. Following the formation of the drill hole 12, stoper 10 is moved away from the hole 12 by distance $D_B$ (FIG. 6) which is approximately equal to the distance between the drill steel axis $A_D$-$A_D$ bore axis $A_B$-$A_B$. The stoper 10 is again activated, urging the drill steel 24 to form a vertical guide bore 62 in the rock complex 14 adjacent to the drill hole 12 to a dept of between about 20 and 60 cm.

Following the formation of the guide bore 62, the sleeve 26 is repositioned over the drill steel 24, and a cable bolt 16 is inserted into the positioning tool 30. To insert the cable bolt 16 initially, the ball 48 is first moved axially in the bore 36 to a position immediately adjacent to the top cover plate 46. An unbulged portion 54 of the bolt 16 is then slid laterally through the throat opening 52 and into general alignment with the bore axis $A_B$-$A_B$. In the initial position, the bolt 16 is maintained in a position intermediate the ball 48 and the infeed opening 42 by the tapering sidewalls of the bore 36. Although not essential, most preferably the top cover plate 46 is configured such that spacing of the outfeed opening 40 and the notched opening 60 has a dimension which is greater than the diameter d of the caming ball 48 by an amount less than the minimum width of the cable bolt 16. With this configuration, the caming ball 48 may be readily removed from the tool body 34 for replacement and/or cleaning prior to the insertion of the cable bolt 16. Once, however, the cable bolt 16 is initially positioned within the bore 36, the added dimension of the cable bolt 16 effectively prevents accidental removal of the caming ball 48 during use of the tendon positioning tool 30.

Following the initial positioning of the cable bolt 16, a number of two-part resin cartridges 66*a*, 66*b* (FIG. 6) are slid into the drill hole 12. Immediately thereafter, the stoper 10 is again positioned such that the bore axis $A_B$-$A_B$ assumes a vertical orientation axially aligned beneath the drill hole 12. The sleeve 26 is positioned in the guide bore 62 and a forwardmost end of the cable bolt 16 is slid upwardly into the drill hole 12.

Figure 4:
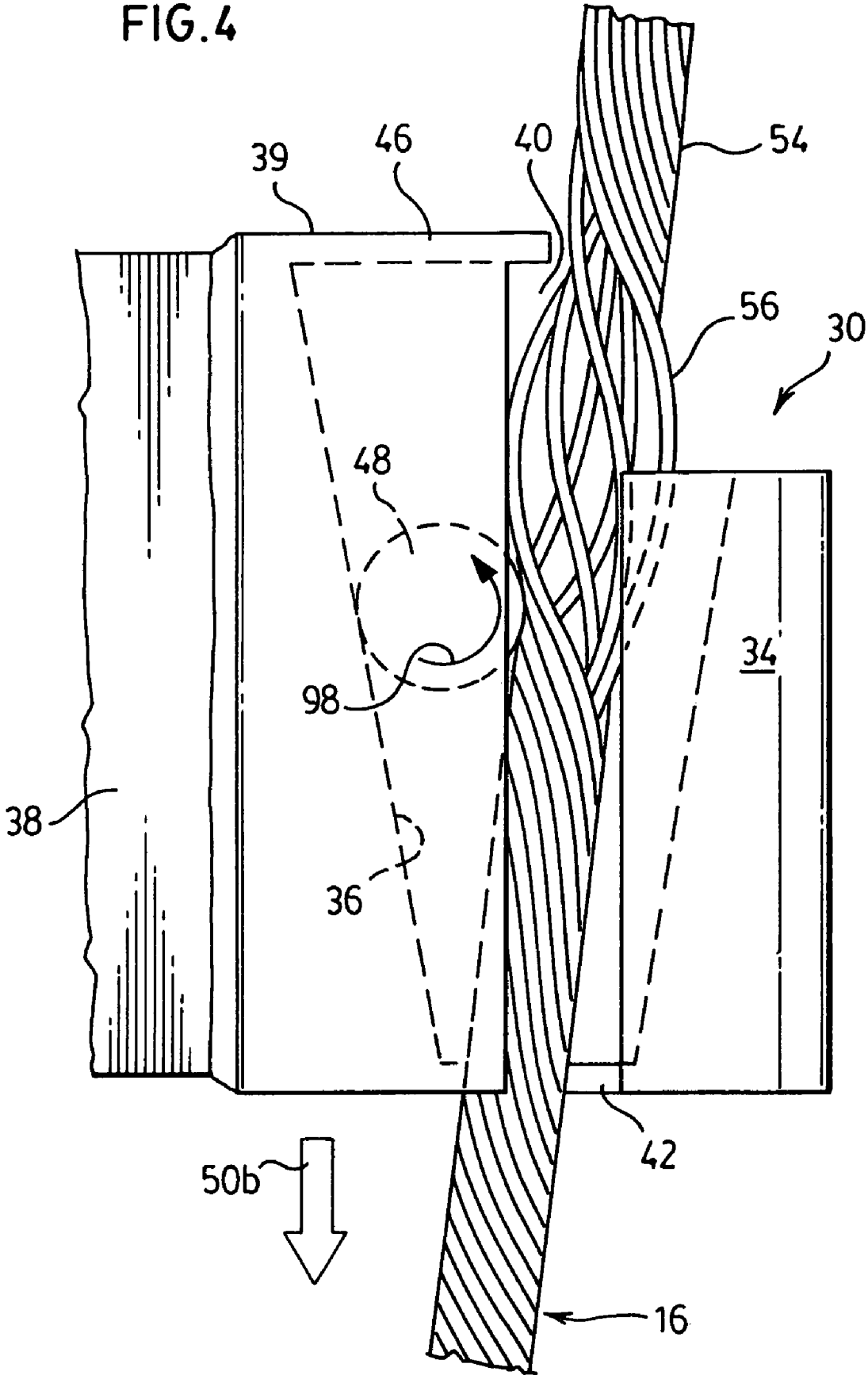
FIG. 4 shows a cross-sectional view of the tendon positioning tool shown in FIG. 2 illustrating the rearward movement of the tool body relative to a tendon away from the rock face, and its repositioning relative to the tool body.

As shown best in FIG. 4, initially as the cable bolt 16 is moved forwardly relative to the tendon positioning tool 30, its contact with the ball 48 results in the ball 48 rotating upwardly in the direction of arrow 98 to move axially relative to the bore 36 towards the outfeed opening 40. As the ball 48 moves into the comparatively enlarged diameter portion of the bore 36 adjacent the end 39, it moves out of frictional and/or wedging contact between the bolt 16 and the tool body 34. In this position, the caming ball 48 is disengaged from the cable bolt 16, permitting the bolt 16 to move relative to tool 30 through the outfeed opening 40.

Figure 5:
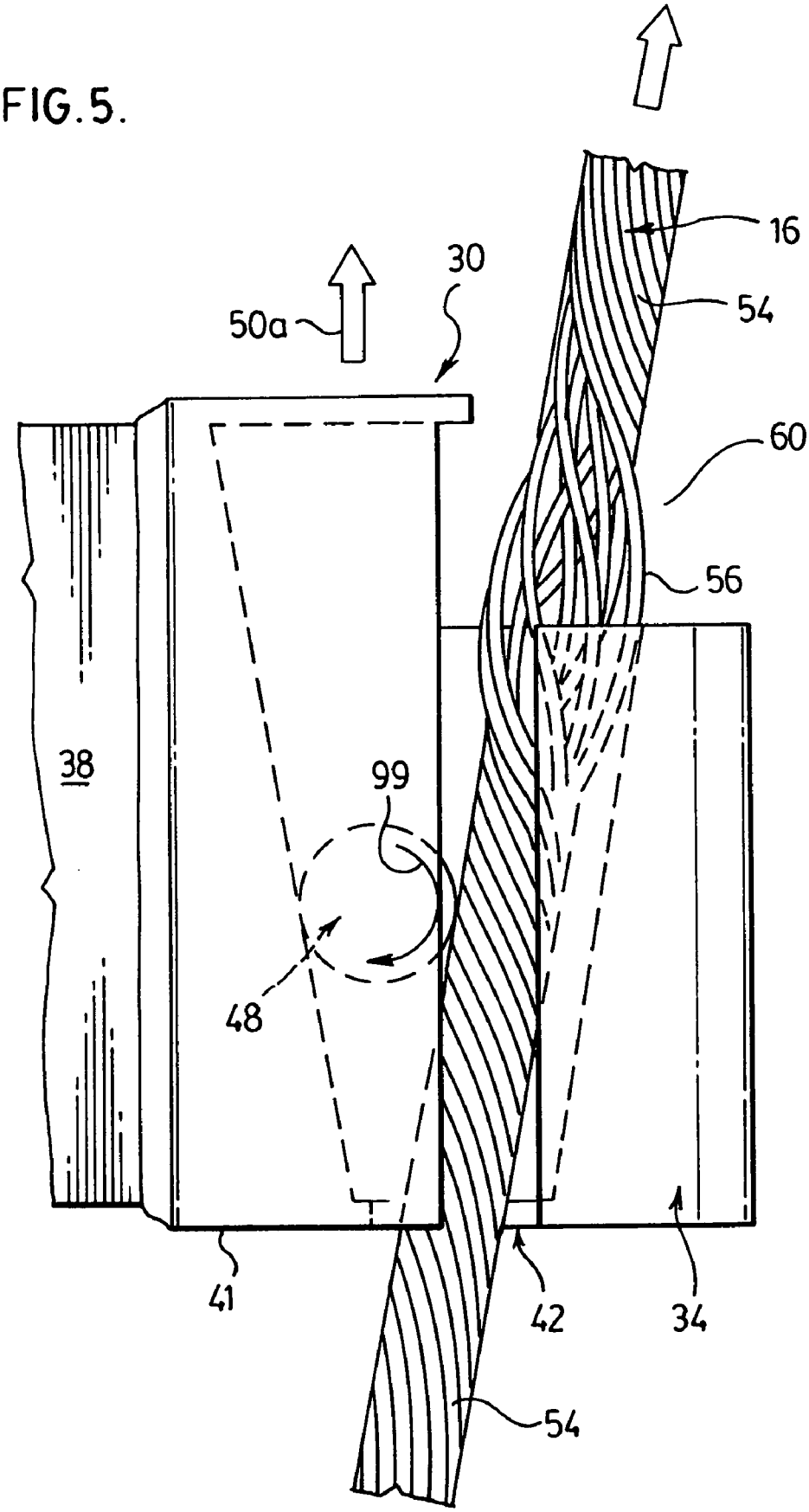
FIG. 5 shows a cross-sectional view of the tendon positioning tool shown in FIG. 4 illustrating the forward movement of the tool body towards a rock face, showing the coupling of the tendon thereto.

As the cable bolt 16 engages the resin cartridges 66*a*, 66*b* and/or resin released therefrom such that further manual insertion of the cable bolt 16 into the drill hole 12 becomes impractical, the stoper 10 is activated to reciprocally move the air-leg 18 in the vertical direction of arrows 50*a*, 50*b*. As shown best in FIG. 5, as the air-leg and tendon positioning apparatus 30 initially move forward in the direction of arrow 50*a*, the caming ball 48 tends to rotate in the direction of arrow 99 to move axially in the bore 36 relative to the body 34 towards the infeed opening 42. The tapering sidewalls of the bore 36 result in the caming ball 48 moving progressively against the bolt 16 until the ball 48 reaches an engaging position whereby the cable bolt 16 is mechanically and frictionally engaged by both the ball 48 and the opposing sidewall portion of the bore 36, effectively locking the bolt 16 in position relative to the body 34. Once so locked, the cable bolt 16 is urged forwardly in the direction of arrow 50*a* further into the drill hole 12 with the forward movement of the tendon positioning tool 30 and air-leg 18.

At the end of the forward stroke of the air-leg 18, the stoper 10 moves the air-leg 18 and tendon pusher 30 in return movement of arrow 50*b*, rearwardly away from the rock face 14*a* (FIG. 1). In such movement, as the body 34 moves away from the rock face 14, the ball 48 again tends to rotate in the direction of arrow 98 and moves relative to the bore 36 towards the outfeed opening 40, until it is relocated in a larger diameter portion of the bore 36. Such relocation again effectively uncoupling the cable bolt 16 from the body 34 and allowing the repositioning of the tool 30 to be moved rearwardly relative to the partially seated cable bolt 16, while preventing its withdrawal from the drill hole 12.

As the bulged portions 56 of the cable bolt 16 move through the body 34, a limited degree of flexure of the cable bolt 16 allows the deflection of part of the bulge portions 56 into the notched opening 60. In this position, the bulged portions 56 may pass without substantial interference from the outfeed end 40.

The stoper 10 is operated to cyclically repeat the forward and rearward movement of the tendon positioning tool 30 in the direction of arrows 50*a*, 50*b* until the cable bolt 16 is slidably moved to the desired seated position within the drill hole 12.

The applicant has appreciated that the simplified construction of the tendon positioning tool 30 enables the cable bolts 16 to be quickly and easily positioned, with minimal susceptibility of the tool 30 to clogging and failure as a result of the accumulation of dust, rock powder and other drilling debris thereon.

Figure 7:
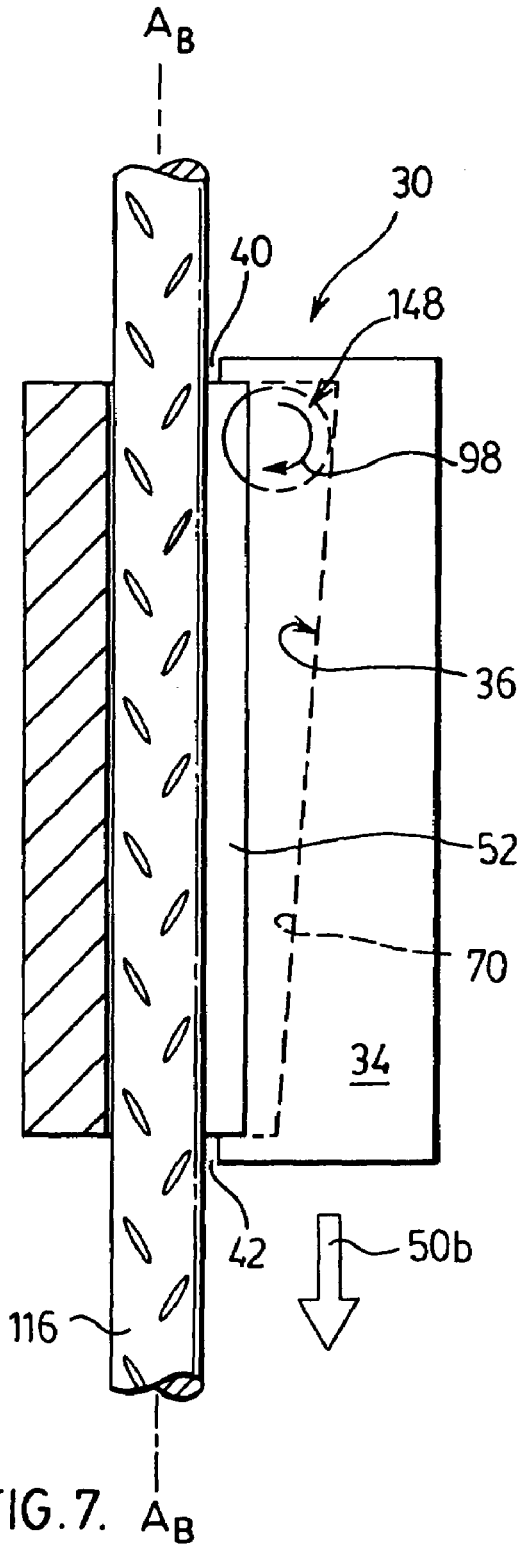
FIG. 7 illustrates a partial cross-sectional view of a tendon positioning tool in accordance with a further object of the invention showing the relative positioning of a wedge cylinder in a position disengaged from a reinforcing tendon, during rearward movement of the tool body away from a rock face.
Figure 8:
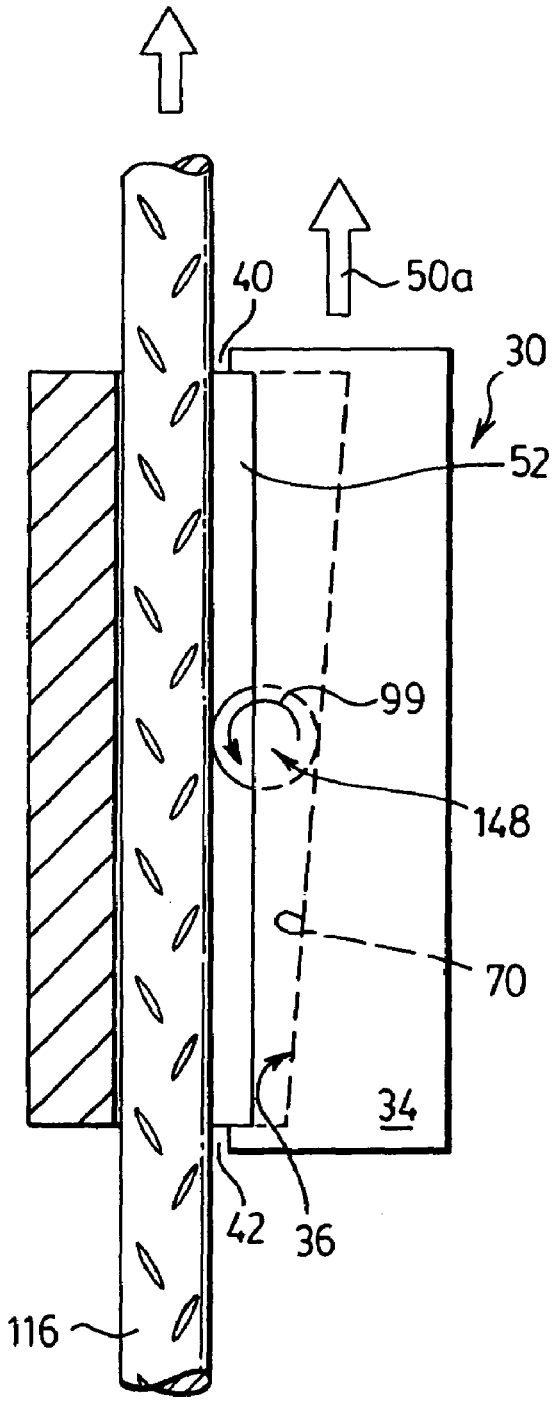
FIG. 8 illustrates a partial cross-sectional view of the tool shown in FIG. 7 with the wedge cylinder moved to a locking configuration in engagement with the tendon, during forward movement of the tool body towards a rock face.

Although FIGS. 1 to 5 describe and illustrate the use of a stoper 10 having the tendon positioning tool 30 as used in the installation of bulged cable bolts 16, the invention is not so limited. The tool 30 is equally suitable for use in the installation of a variety of different types of tendons used in ground stabilizing and support applications including without restriction, cone bolts, strand bolts, threaded rebar and the like. Reference may be had to FIGS. 7 and 8 which show one possible alternate embodiment of the invention wherein like reference numerals are used to identify like components. In FIGS. 7 and 8, the tendon positioning tool 30 is configured for installation of conventional ribbed rebar 116. As rebar 116 is not provided with bulged portions, the body 34 of the tendon positioning tool 30 may be provided without a notched opening 60 for more simplified manufacture.

In FIGS. 7 and 8, the tendon positioning tool 30 is provided with a bore 36 which is asymmetrically formed about an elongated bore axis $A_B$-$A_B$ (FIG. 7). The bore 30 includes along one radial side portion a generally planar sloping side surface 70 which tapers inwardly from the forward outfeed opening 40 to the rearward infeed opening 42.

A cylindrical wedge member 148 is provided which is repositionable relative to the body 34 between engaging and uncoupled positions in a similar manner to that previously described. In particular, as shown in FIG. 8, as the tendon positioning tool 30 is moved forwardly towards a rock complex (not shown) in the direction of arrow 50*a*, the wedge cylinder 148 tends to rotate in the direction of arrow 99 and is moved along relative to the bore 36 towards the infeed end, and into frictional engagement with the tendon 116. As with the earlier embodiment, the engagement between the tendon 116, the bore 34 and/or the wedge cylinder 148 restricts any axial movement of the tendon 116 rearwardly relative to the infeed opening 42. As a result, the tendon 116 and positioning tool 30 are moved forwardly in the direction of arrow 50*a* together as a unit.

As shown in FIG. 7, on the return movement of the tendon positioning tool 30 away from the rock face in the direction of arrow 50*b*, the wedge cylinder 148 tends to rotate in the direction of arrow 98 and is moved upwardly relative to the body 34 towards the outfeed opening 40. As the cylinder 148 is moved into the larger diameter end of the bore 36, it releases the tendon 148. In the manner previously described, the tendon 148 may thus be repositioned forwardly relative to the body 34.

Although the detailed description describes and illustrates the tendon positioning tool 30 as being used in a vertical orientation with a stoper 10, the invention is not so limited. It is to be appreciated that the tendon positioning tool 30 could be used in angled or horizontal orientations as well. In addition, the tool 30 could also be used with a variety of different rock boring tools, including without limitation jacklegs or other tools having pneumatically, hydraulically, and/or electronically reciprocally movable drive structures. In an alternate less preferred configuration, the tendon positioning tool 30 could be provided as a stand alone tool which is activatable for reciprocal movement.

While the detailed description of the invention describes the tool body 34 as being permanently secured to the air-leg 18 by weldments, the invention is not so limited. In an alternate construction, the body 34 and/or the entire tool 30 may be detachable from the stoper 10. It is to be appreciated that such a detachable construction could advantageously permit the substitution of different tool bodies 34 having different sized or tapered bores 36, or throat openings 52 as may be best suited for use with different types of reinforcing tendons depending on the rock complex geology and site of installation.

Although the detailed description describes the tendon pusher body 34 as including an axially extending throat opening 52, the invention is not so limited. It is to be appreciated that the throat opening 52 could be omitted in its entirety and the cable bolt 16 simply fed into the positioning tool 30 through the infeed opening 42.

While the detailed description describes the use of a ball 48 and/or cylinder 148 as being used to wedge and secure tendons in place during forward movement of the tool 30, the invention is not so limited. It is to be appreciated that numerous other constructions may be used as suitable wedging elements and which will now become readily apparent.

Although the detailed description describes and illustrates various preferred embodiments, the invention is not so limited. Many modifications and variations will now appear to persons skilled in the art. For a definition of the invention, reference may be had to the appended claims.

I claim:

1. A tendon positioning apparatus for urging a reinforcing tendon forwardly into a bore hole formed in a rock face, the apparatus comprising, a body having a rearward infeed end and a forward outfeed end positionable proximate to said rock face, an axially extending bore extending through the body from the infeed end to the outfeed end, the bore being generally frustoconically shaped and tapering inwardly from an enlarged diameter portion spaced towards the outfeed end to a reduced diameter portion spaced towards the infeed end, the reduced diameter portion being sized to permit sliding movement of the tendon therethrough, a wedge member disposed at least partially in said bore and movable in an axial direction relative to said body between an engaging position, wherein said wedge member is spaced towards the reduced diameter portion to be frictionally engageable with a tendon therein, such that engagement between the tendon and the bore and/or the wedge member restricts axial movement of the tendon rearwardly relative the infeed end, and an uncoupled position, wherein said wedge member is moved towards the enlarged diameter portion to permit forward sliding of the tendon relative to the outfeed end of the body, and wherein the body further defines an axially elongated throat portion opening laterally into the bore and extending substantially from the infeed end to the outfeed end, the throat portion being sized to permit lateral movement of a portion of the tendon therethrough into the bore.

2. An apparatus as claimed in claim 1 wherein the wedge member includes at least one ball having a diameter selected at between about 0.75 cm and 3 cm.

3. An apparatus as claimed in claim 2 wherein said tendon comprises a bulged cable bolt, said body further including a notched end portion adjacent to the outfeed end, the notched open end portion being sized to at least partially receive therein bulged portions of the cable bolt as the cable bolt is moved axially relative to said body.

4. An apparatus as claimed in claim 1 wherein the wedge member comprises a steel ball having a diameter selected smaller than a diameter of the outfeed end by an amount less than the width of the tendon.

5. An apparatus as claimed in claim 1 further including a drive selectively operable to reciprocally move the body in the axial direction towards and away from the rock face.

6. An apparatus as claimed in claim 5 wherein said body is reciprocally movable in a vertical direction a distance selected at between about 10 cm and 50 cm.

7. An apparatus as claimed in claim 6 wherein the tendon comprises a bulged cable bolt, and the portion of the tendon comprises an unbulged portion.

8. An apparatus as claimed in claim 1 wherein said body is connected as a unitary unit to a reciprocally movable air-leg of a rock boring tool selected from the group consisting of a stoper and a jackleg.

9. A rock boring tool for use with a drill steel for forming a drill hole in a rock face, the tool comprising a vertically elongated air-leg and a drive selectively operable to reciprocally move said air-leg in a vertical direction, the air-leg including a nose portion positionable proximate to the rock face and having a socket configured for coupling the drill steel thereto, and a tendon positioning assembly for urging a reinforcing tendon into the drill hole, the assembly comprising, a body, a bore extending through the body along an axis from an infeed end opening to the outfeed end opening, the bore having at least one surface portion tapering inwardly from an enlarged diameter portion spaced towards the outfeed end opening towards a reduced diameter portion spaced towards infeed end opening, the bore being sized to permit sliding movement of the tendon therealong, a wedge member disposed at least partially in said bore, the wedge member movable in the axial direction relative to said body between an engaging position spaced towards the reduced diameter portion so as to be frictionally engageable with a tendon, whereby engaging contact between the tendon and at least one of the bore and the wedge member restricts relative axial sliding of the tendon downwardly from the body, and an uncoupled position wherein said wedge member is moved towards the enlarged diameter portion to permit sliding of the tendon upwardly relative to the body, the body further defining a generally vertically elongated open throat extending laterally into the bore, the throat being sized to permit movement of at least part the tendon therethrough laterally into the bore.

10. The tool as claimed in claim 9 wherein the bore comprises a generally frustoconically shaped bore and the wedge member is selected from the group consisting of a metal cylinder and a metal ball having a diameter selected at between about 0.75 cm and 3.5 cm.

11. The tool as claimed in claim 10 wherein said positioning assembly is coupled to said air-leg adjacent said nose portion with said bore being spaced a lateral distance relative to said socket selected at between about 5 and 20 cm.

12. The tool as claimed in claim 11 wherein said tendon comprises a bulged cable bolt and said body further includes a notched open end portion adjacent to the outfeed end, the notched open end portion being sized to at least partially receive therein bulged portions of the cable bolt as the tendon is moved axially relative to said body.

13. The tool as claimed in claim 11 selected from the group consisting of a hand-held stoper, and a jackleg, and further comprising a locating sleeve positionable in said socket, said locating sleeve being engageable with a guide bore formed in said rock face adjacent said drill hole to assist in orienting said tool.

14. A tendon positioning apparatus for sliding a reinforcing tendon into a drill hole formed in a rock face, the apparatus comprising, a body having a rearward infeed end opening and a forward outfeed end opening, a bore extending generally axially through the body from the infeed end opening to the outfeed end opening, the bore sized to permit limited sliding movement of the tendon therethrough and having at least one sidewall portion tapering inwardly from an enlarged diameter portion spaced closest the outfeed end towards a reduced diameter portion spaced towards the infeed end opening, a wedge member disposed in said bore and movable in an axial direction relative to said body between an engaging position, wherein said wedge member is spaced towards the reduced diameter portion whereby frictional engagement between the tendon and at least one of the bore and the wedge member restricts axially sliding of the tendon rearwardly relative the infeed end opening, and an uncoupled position, wherein said wedge member is moved towards the enlarged diameter portion to permit relative sliding of the tendon forwardly from the outfeed end opening therepast, and wherein the body includes an axially elongated throat portion opening laterally into the bore, the throat portion being sized to permit lateral movement of at least a portion of the tendon therethrough.

15. The apparatus as claimed in claim 14 wherein the bore is generally frustoconically shaped and the wedge member comprises a ball having a diameter selected at between about 1 cm and 3 cm.

16. The apparatus as claimed in claim 14 further including a drive selectively operable to reciprocally move the body towards and away from the rock face.

17. The apparatus as claimed in claim 16 wherein the body is connected to a nose portion of a stoper as a unitary unit.

18. The apparatus as claimed in claim 17 wherein said body is reciprocally movable with said nose portion in a vertical direction a distance of between about 10 cm and 40 cm.

19. The apparatus as claimed in claim 18 wherein the tendon comprises a bulged cable bolt, and said body further includes a notched open end portion adjacent to the outfeed end opening, the notched open end portion being sized to at least partially receive therein bulged portions of the cable bolt as the cable bolt is moved axially relative to said body.

* * * * *